US005959203A

United States Patent [19]

Ajjoul

[11] Patent Number: 5,959,203

[45] Date of Patent: Sep. 28, 1999

[54] METHOD FOR AUTOMATIC IDENTIFICATION OF THE NATURE OF A HYDROCARBON PRODUCTION WELL

[75] Inventor: Mohammed Ajjoul, Antony, France

[73] Assignee: ELF Aquitaine Production, Courbevoie, France

[21] Appl. No.: 08/840,456

[22] Filed: Apr. 18, 1997

[30] Foreign Application Priority Data

Apr. 23, 1996 [FR] France ..... 96 05072

[51] Int. Cl.[6] ..... E21B 47/06

[52] U.S. Cl. ..... 73/152.51; 73/152.02; 166/250.07

[58] Field of Search ..... 73/152.02, 152.05, 73/152.51, 152.52; 166/250.01, 250.07; 364/422, 804

[56] References Cited

U.S. PATENT DOCUMENTS 4,597,290 7/1986 Bourdet et al. ..... 73/152.51
4,607,524 8/1986 Gringarten ..... 73/152.02
4,677,849 7/1987 Ayoub et al. ..... 73/152.51
4,797,821 1/1989 Petak et al. ..... 73/152.52

*Primary Examiner*—Hezron Williams
*Assistant Examiner*—Chad Soliz
*Attorney, Agent, or Firm*—Oblon, Spivak, McClelland, Maier & Neustadt, P.C.

[57] ABSTRACT

The present invention proposes a method for automatic identification of the nature of a hydrocarbon production well, the nature of the associated reservoir and possible limits of this reservoir. It consists in processing the recordings of the value of the pressure at the well bottom, in particular by employing the second derivative of a function of the pressure with respect to a function of time, as well as particularly efficient means for smoothing and filtering the processed signals. The invention allows a large number of models to be taken into account and gives real solutions to the problems posed by the identification of hydrocarbon production wells. It constitutes an excellent tool for acquiring knowledge regarding hydrocarbon deposits which is necessary for exploiting them rationally.

2 Claims, 3 Drawing Sheets

METHOD FOR AUTOMATIC IDENTIFICATION OF THE NATURE OF A HYDROCARBON PRODUCTION WELL

TECHNICAL FIELD

The present invention relates to a method for automatic identification of the nature of a hydrocarbon production well, the nature of the reservoir associated with the well and the possible limits of the said reservoir, on the basis of recording measurements of the pressure of the hydrocarbons at the well bottom as a function of time.

The results of this identification allow accurate estimation of the future outputs and pressures of a hydrocarbon production field. In particular, these data condition the dimensioning of the surface production equipment and determine the production conditions for the deposit.

PRIOR ART

The purpose of identifying the nature of a hydrocarbon production well, the nature of the reservoir associated with this well and possible limits of this reservoir, is to obtain precise qualitative and quantitative information regarding a hydrocarbon deposit at the start of production.

On the basis of this information, it is possible to predict the production of the well, the main parameters of the reservoir, the effect of acidification or fracturing operations and, in general, the dynamic behaviour of the well, these being the determining factors for the future exploitation of a deposit.

One known technique for carrying out this identification is the "well test" method, which consists in setting a flow rate of hydrocarbons produced by the well being studied, in recording the values of the pressure of the hydrocarbons at the well bottom, as a function of time, and then in interpreting the recordings thus obtained.

Known methods for interpreting these recordings consist in employing numerical fitting simulators based on multiphase flow calculations.

A first known method, which is not an automatic method, consists in visually selecting known standard configurations of wells, reservoirs and reservoir limits, in order to limit the number of possible interpretations. This selection is made by an expert who then identifies the reservoir/well system corresponding to the test by comparing the results of the pressure recordings with the selected standard configurations. The general approach consists in employing standard pressure curves using dimensionless parameters, but requires simplifying assumptions which sometimes place severe restrictions on the conditions under which they can be used. This method can advantageously be employed by using the first derivative of the pressure with respect to time, in order to determine the succession of characteristic flows, visible in the form of sections of straight lines on the test results, and is carried out visually.

A second known method of interpreting the results of a well test is described in the document: "Use of artificial intelligence for model identification and parameter estimation in well testing interpretation" O. F. ALLAIN, thesis, University of Stanford (California), December 1988.

This method includes three steps:

an observation step, consisting in establishing a sketch of the first derivative of the pressure measurement as a function of time, by successive approximation of the derivative by straight-line segments, using a least-squares fit. Then in translating the segmented curve of the first derivative, governed by a certain number of basic syntax rules, and in the form of words in a simple syntax. This identification is performed by searching on the curve of the first derivative of the pressure for horizontal straight lines and transitions represented by rises and falls on the same curve, which are referred to as characteristic flows.

a learning step, consisting in recording, in a segmented form and then in a form of words, a limited number of pressure derivative curve models representing the nature of typical wells and reservoirs.

a qualitative and quantitative recognition step, consisting in superposing the words representing the first derivative of the pressure with recorded known models, in order to select those which represent the well and the reservoir under study, and then in comparing the selected models while allowing overlaps.

This method has the drawback of processing a small number of models. For example, two-layer reservoirs, partial penetration and multiple limits are not represented. Furthermore, the allowed overlaps of the models run the risk of demonstrating phenomena which do not exist, the risks increasing with the number of models.

Another method for semi-automatic interpretation of a well test has been developed at Heriot-Watt University.

It is described in the document: "Feature selection and extraction for well test interpretation by artificial intelligence approach", SPE 19820, October 1989.

This method is based on representing the signal obtained by differentiating the pressure measurement with respect to time, using symbols on which reasoning is simulated in order to adopt a standard configuration of the well and reservoir under study.

It includes the following three steps:

a step of preprocessing the signal representing the recorded pressure derivative, which consists in eliminating the noise using GCV type smoothing (generalized cross-validatory smoothing, Silverman 1985), in segmenting the curve which is obtained and in representing it in the form of vector elements.

a step of identifying the standard configurations.

a step of calculating the various parameters of the solution which is adopted and of validating the results which are obtained.

This method has the drawback of requiring the intervention of an operator during the preprocessing step and mainly in the segmentation of the first derivative of the pressure.

The three methods described in brief above only partially address the problems posed by the automatic identification of wells, reservoirs and reservoir limits. In particular, they require human intervention in the preprocessing or observation step. Furthermore, they do not allow a large number of models to be taken into account.

DESCRIPTION OF THE INVENTION

The object of the present invention is to overcome these drawbacks and to provide an efficient method for automatic identification of the nature of a hydrocarbon production well, the nature of the associated reservoir and the possible limits of this reservoir, which method is rich in models, provides a real solution and does not show phenomena which do not exist. It allows amplification of the trend changes observable on the curve of the first derivative of the pressure, which improves the quality of the interpretation.

The method of the invention consists, on the basis of recording the pressure of the hydrocarbons at the well bottom as a function of time, in performing the following steps:

preprocessing the measurements of the pressure at the well bottom in order to obtain a preprocessed signal, by calculating the first derivative of the pressure at the well bottom with respect to a function of time, representing the shape of the preprocessed signal in a coded form, performing structural analysis of the coding results obtained in the previous step, using structural shape recognition techniques in order to identify one or more known models, coded in the same form as the preprocessed signal, the well, the reservoir and the possible limits of the said reservoir.

The invention is characterized in that the step of preprocessing the measurements of the pressure furthermore consists in performing the following substeps:

smoothing the result of the calculation of the first derivative of the pressure, estimating the regular points of the said smoothed first derivative, then replacing the results of the smoothing by an equivalent signal sampled with constant step, filtering the said signal, calculating the second derivative of the pressure at the well bottom by differentiating a function of the said filtered signal with respect to a function of time, filtering the result of the calculation of the second derivative, carrying out linear segmentation of the said filtered second derivative, in order to obtain the preprocessed signal, and in that the step of representing the shape of the preprocessed signal in a coded form consists in performing the following substeps:

choosing a syntax including an alphabet consisting of a series of letters for describing the direction of the variations of the preprocessed signal and attributes for describing the values of the variations, associating, with each segment of the preprocessed signal, the letter of the alphabet describing the direction of variation of the signal, calculating the slope of each segment of the preprocessed signal, which constitutes the value of the attribute, the sequence of letter/attribute pairs constituting a phrase representing the preprocessed signal, itself representing the second derivative of the pressure.

According to a particular embodiment of the invention, the second derivative of a function of the pressure of the hydrocarbons at the well bottom with respect to a function of time is calculated by applying the following formula: $P''(t)=dLogP'(t)/dLog(t)$, in which:

$P''(t)$ represents the second derivative of a function of the pressure with respect to a function of time, t represents time $P'(t)$ represents the first derivative of the pressure with respect to a function of time, calculated in known fashion by applying the following formula: $P'(t)=dP(t)/dLog(t)$, in which $P(t)$ represents the pressure and t represents time.

BRIEF DESCRIPTION OF THE DRAWINGS

Other characteristics and advantages of the invention will emerge when reading the following detailed description, with reference to the appended drawings, in which.

DETAILED DESCRIPTION OF THE INVENTION

Figure 1:
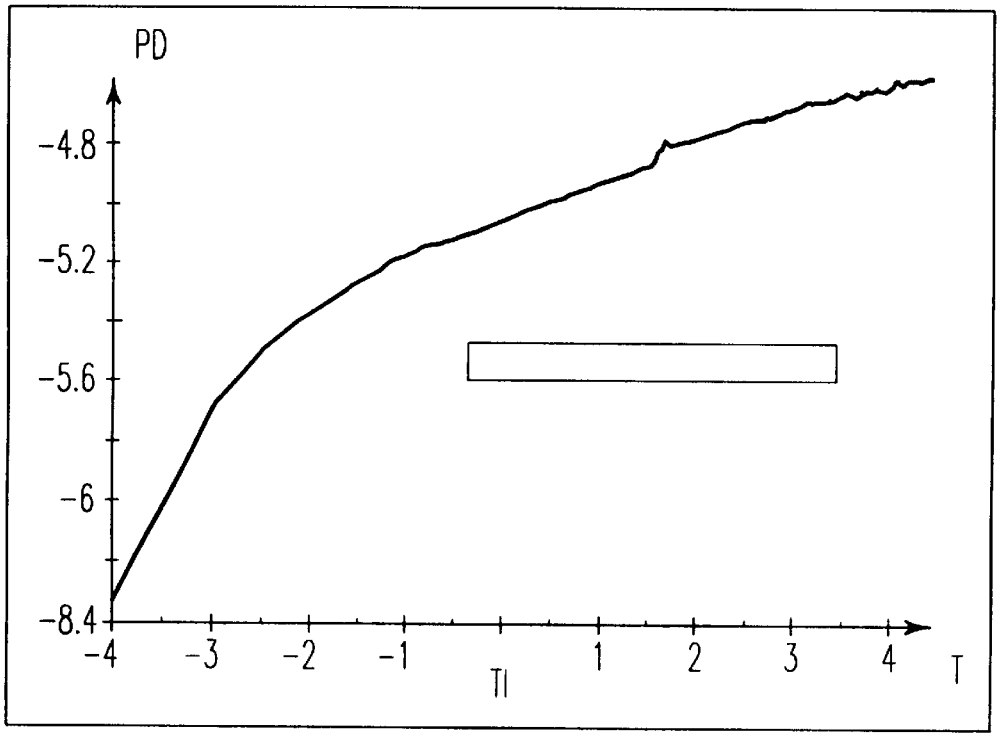
FIG. 1 represents the recording of the value of the pressure at the well bottom as a function of time.

According to a particular embodiment of the invention, the method for automatic identification of the nature of a pressurized hydrocarbon production well, the nature of the associated reservoir and the possible limits of this reservoir, consists, in a preliminary operation, in keeping constant the flow rate of the hydrocarbons produced by the well, starting from an initial instant ti, and in discontinuously recording, as a function of time t, the oil pressure $P(t)$ measured at the well bottom, this pressure being illustrated by the curve in FIG. 1.

The method of the invention then consists in performing the following three steps, each comprising substeps:

step 1: preprocessing the recorded measurements of the pressure of the hydrocarbons at the well bottom, in order to obtain a preprocessed signal step 2: representing the shape of the preprocessed signal in coded form step 3: structural analysis of the results of the coding of the shape of the preprocessed signal, in order to identify the well, the reservoir and the possible limits of the said reservoir with a known model.

Figure 2:
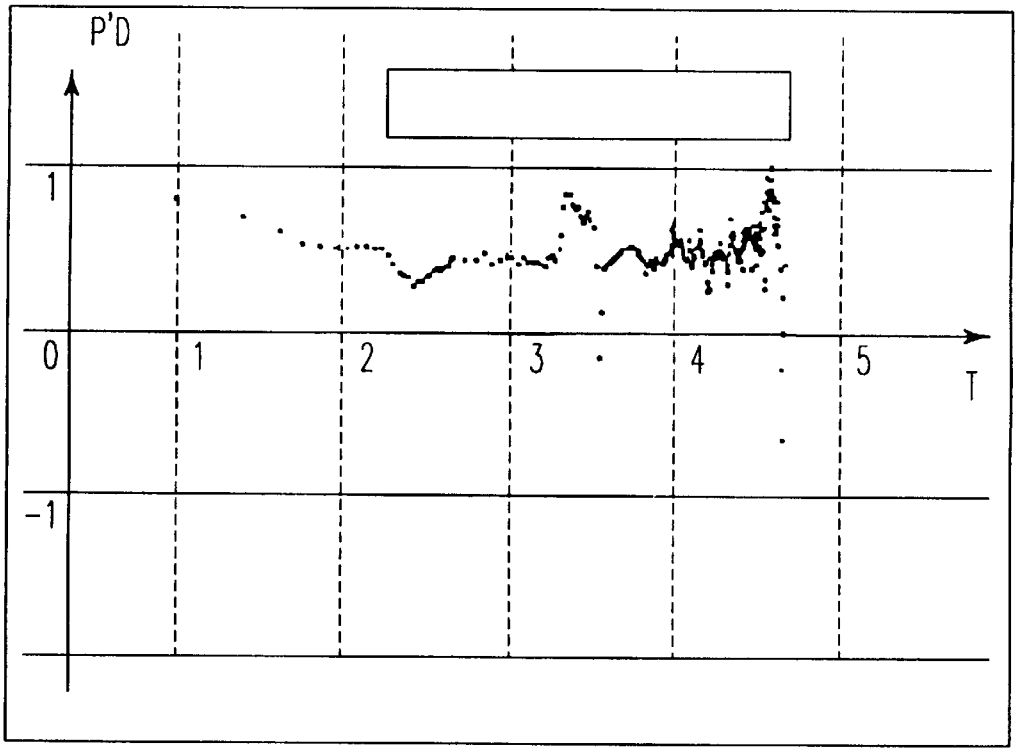
FIG. 2 represents the first derivative of the pressure at the well bottom as a function of time.
Figure 3:
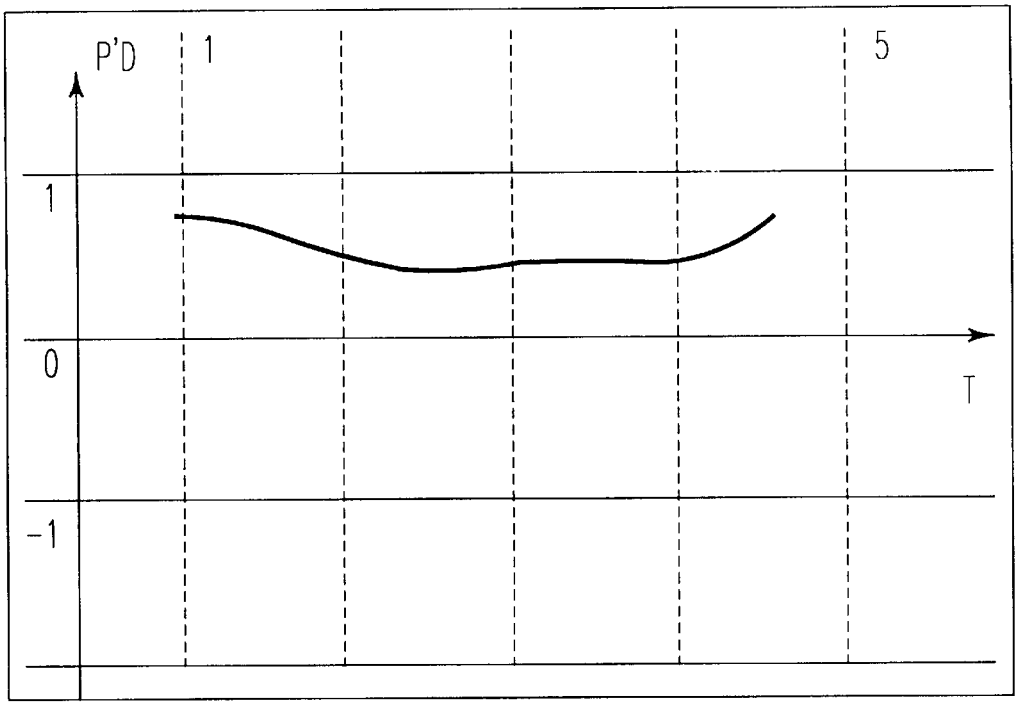
FIG. 3 represents the smoothed first derivative of the pressure at the well bottom as a function of time.

According to a first characteristic of the invention, the step of preprocessing the recorded measurements of the pressure of the hydrocarbons at the well bottom includes the following substeps:

calculating the derivative of the pressure with respect to time, according to the following formula:

$$P'd=dPd/dLn(td/cd)$$

in which,

Pd represents the dimensionless pressure of the hydrocarbons at the well bottom, calculated from $Pd=Pi-Pw(t)$, with Pi representing the initial pressure at instant ti, and $Pw(t)$ representing the pressure at instant t at the well bottom.

td represents the dimensionless time calculated from t cd represents the dimensionless capacity of the well, calculated from $c=-\delta V/\delta P$, with $\delta V$ representing the variation in the volume of fluid resulting from a variation $\delta P$ in the pressure applied to the well. The results of this calculation are illustrated by FIG. 2.

smoothing the first derivative of the pressure, by using the so-called diffuse approximation method described in the document "Approximation diffuse, bilan et perspectives" [Diffuse approximation, appraisal and prospects] by P. VILLON. B. NAYROLLES and G. TOUZOT, 1991. The results illustrated in FIG. 3 are obtained.

estimating the regular points of the smoothed first derivative, which consists in replacing the result of the smoothing by an equivalent signal sampled with constant step. The method adopted is a simple estimation by linear interpolation, which consists in constructing the curve joining the points of the test by straight-line segments. The estimated points constitute sampling, with constant step T, of the points of this curve.

The results of this estimation of the value of the first derivative of the pressure at the well bottom are then filtered by applying a Butterworth filter, the general transfer function of which is expressed as follows:

$$H(Z) = \frac{a(1+Z^{-1})^2}{1+b_1Z^{-1}+b_2Z^{-2}}$$

in which, $a=1/(1+\sqrt{2}\ u+u^2)$ $b_1=2a(1-u^2)$ $b_2=a(1-2\sqrt{2}\ u+u^2)$ $u=1/\tan(\pi\ fcT)$ fc is the cut-off reference of the filter, chosen to be equal to 1.0

T represents the sampling period the product fc.T satisfies the Shannon criterion.

Figure 4:
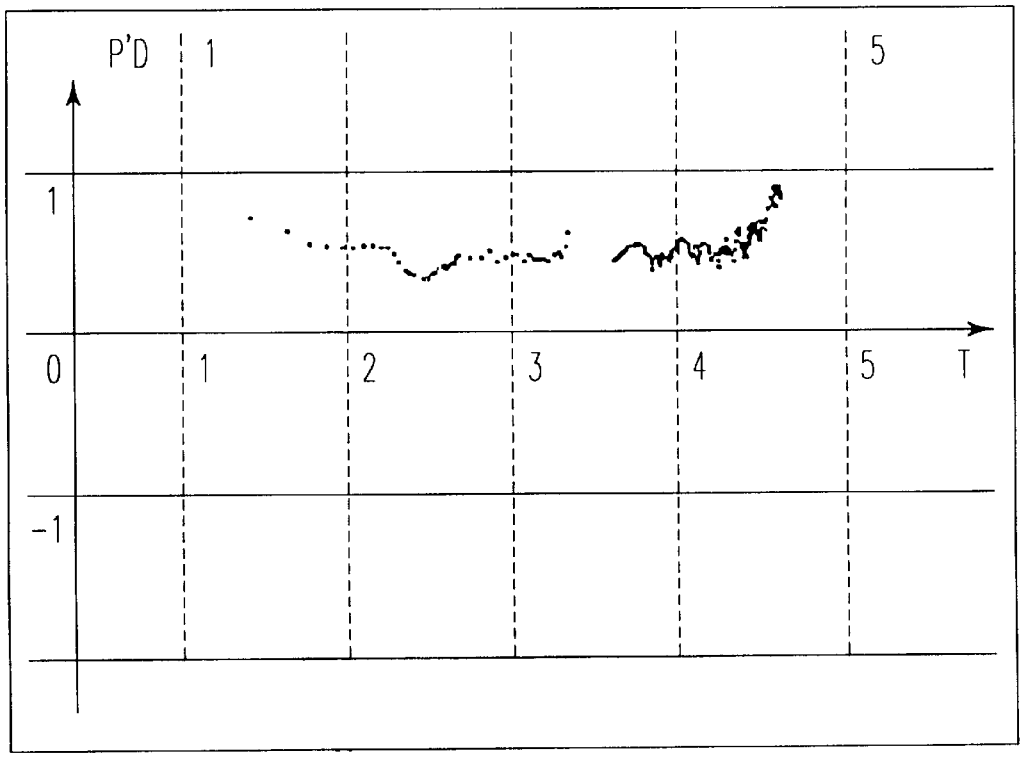
FIG. 4 represents the signal, equivalent to the first derivative, sampled with constant step after filtering.

The results P'd of the filtering of the smoothed first derivative of the pressure at the well bottom which are obtained in this way are represented in FIG. 4. The results make it possible to calculate the second derivative of the said pressure, by applying the following formula:

$$P''d=dLog(P'd)/dLog(td/cd)$$

in which:

P"d represents the second derivative of the pressure at the well bottom

P'd represents the first derivative of the pressure at the well bottom, smoothed and then filtered td represents the dimensionless time, calculated from t cd represents the dimensionless capacity of the well, calculated from $c=-\delta V/\delta P$, with $\delta V$ representing the variation in the volume of fluid resulting from a variation $\delta P$ in the pressure applied to the well.

In order to calculate this second derivative at a point M on the P'd curve, a window, centred on M and with given width, is opened and a linear regression of the points contained in the window is carried out. The value of the derivative is thus the slope of the curve. It is important to note that this differentiation method also provides smoothing.

The smoothing increases with the size of the window, which will be chosen between 0.2 and 0.4, and preferably equal to 0.3.

Figure 5:
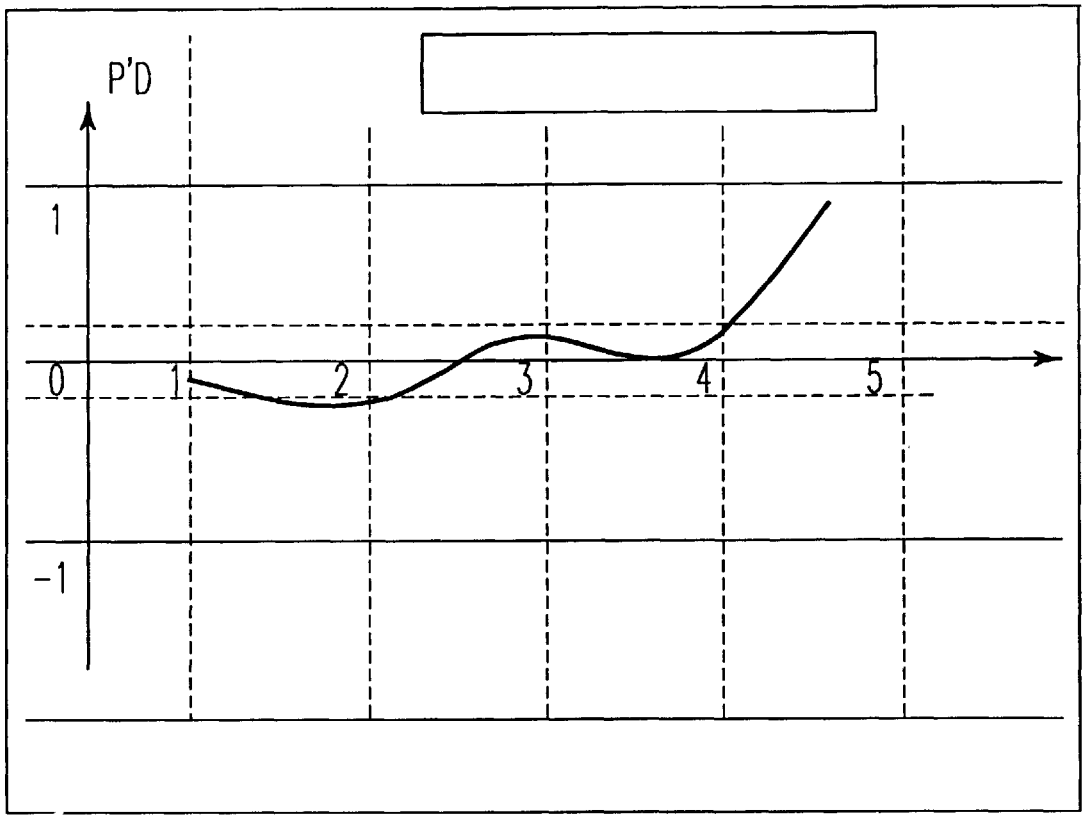
FIG. 5 represents the second derivative of the pressure at the well bottom as a function of time.

The second derivative thus obtained is filtered with the same Butterworth filter as that described above, and is represented in FIG. 5.

The last substep of step 1 of the invention consists in linear segmentation of the second derivative of the pressure at the well bottom, in order to represent the characteristic flows of the well and of the reservoir by segments of horizontal straight lines, and the transitions by rises, falls or combinations of the two, that is to say peaks.

Several known methods have been developed for carrying out linear segmentation of a curve. For the method of the invention, we have chosen the one developed by T. PAVLIDIS and S. L. HAROVITZ which is described in the document "Segmentation of plane curves", I.E.E.E. transactions on computers, vol c-23, No. 8, August 1974

This method makes it possible to attain three objects which are essential to the invention:

extraction of the characteristics of the curve compression of the data filtering the noise of the curve It also has the advantage of being easy to program and of giving satisfactory results in an acceptable calculation time.

In general, it consists, given a plane curve defined by a series of points $(x_i, y_i)$, i=1 to N, in determining the minimum number n of intervals $S_1$, $S_i$, $S_n$ such that the approximation by a polynomial of degree m on each of the intervals does not generate an error greater than a value fixed in advance. Each of these intervals is defined by the pair $(\alpha_i, \alpha_{i+1})$, in which $\alpha_i$ is an increasing series, $x_i$ is the time axis and $y_i$ is the axis representing the second derivative of the pressure.

The method of the invention involves searching for the base flows which are manifested by sections of horizontal straight lines on the second derivative of the pressure at the well bottom.

The approximation will therefore be made by polynomials of degree 1.

The problem is to determine the series $(\alpha_i)$ $(a_i)$ and $(b_i)$ which minimize the number of segments n, while taking the error into account ($a_i$, $b_i$ are the coefficients of the approximation polynomial on the interval $S_i$, $y=a_i_b_i*x$)

The error calculation is based on the Euclidian distance. The following substep consists in performing linear segmentation of the curve representing the second derivative of the pressure at the well bottom, by using the "split and merge" algorithm described in the document mentioned above, the authors of which are T. PAVLIDIS and S. L. HAROVITZ.

This segmentation procedure is fully automatic and requires no external intervention.

The second step in the method of the invention is that of representing in coded form the preprocessed signal representing the second derivative of the pressure at the well bottom, obtained from the first step. It consists in transcribing the said signal into a chosen syntax and in transcribing into the same syntax the theoretical flow models which will be used in the following analysis step. This coding of the models actually constitutes a learning stage of the identification method of the invention.

The syntax chosen is an alphabet A and attributes At. Each segment of the second derivative of the pressure, obtained in the previous step, is represented by a letter of the alphabet A and an attribute. The letters of the alphabet A describe the direction of variation of the second derivative, as well as the levels of the same derivative. The attributes specify the values of these variations.

The alphabet A used is as follows:

A={St, C−, C+, D−, D+, P−, P+}

St represents a stabilization

C+ represents an increase with a positive sign

C− represents an increase with a negative sign

D+ represents a decrease with a positive sign

D− represents a decrease with a negative sign

P+ represents a positive peak

P− represents a negative peak

The attributes used are as follows:

$$At=\{-5/4,-1,-3/4,-1/2,-1/4,\ 0,+1/4,+1/2,+3/4,+1,+5/4\}$$

The general principle of the coding is to assign a letter of the alphabet A to each segment and then to isolate the peaks using combination rules. For example, C+ followed by D+ is changed to P+.

Before associating a letter with a segment, the slope of each segment is calculated and a value is assigned to it.

Thus, if pi is the calculated slope of the segment i, the value v(i) is assigned to it according to the following rules, s0 representing the value of the slope of a so-called stable segment.

| With s0 = 0.1 | |
|---|---|
| If (pi < s0) | then val (i) = 0 |
| If (pi > s0 and pi < 2*s0) | then val (i) = 2 |
| If (pi < −s0 and pi < −2*s0) | then val (i) = −2 |
| If (pi > 2*s0) | then val (i) = 1 |
| If (pi < −2*s0) | then val (i) = −1 |

The + sign indicates an increase and the − sign indicates a decrease of the second derivative of the pressure.

Neighbouring segments associated with the value +2 or −2 are combined.

A letter of the alphabet A is then assigned to each segment obtained by the linear segmentation, by applying simple rules.

If val(i)=0 then the letter assigned to the segment i is St

If val(i)=−1 and if the second derivative at the origin of the segment i is negative, then the letter assigned to the segment i is D−

If val(i)=−1 and if the second derivative at the origin of the segment i is positive, then the letter assigned to the segment i is D+

If val(i)=1 and if the second derivative at the origin of the segment i is positive, then the letter assigned to the segment i is C+

If val(i)=1 and if the second derivative at the origin of the segment i is negative, then the letter assigned to the segment i is C−

After assignment of the letters of the alphabet to the segments, which will hereafter be referred to as primitives, the local maxima and minima of the first derivative are isolated on the second derivative.

Neighbouring primitives having the same letter of the alphabet are then combined.

Lastly, the peaks (P+, P−) are constructed by combining suitable segments, namely:

| | | |
|---|---|---|
| − | (C+) + (St) + (D+) | gives P+ |
| − | (C+) + (D+) | gives P+ |
| − | (D−) + (St) + (C−) | gives P− |
| − | (D−) + (C−) | gives P− |

This coding of the segments into primitives is completed by calculating the attributes. This calculation is performed for two types of primitives: the stabilities and the peaks. The primitives C+, C−, D+ and D− do not require the calculation of an attribute, this being replaced by the sign.

In order to retain fine segmentation, a final processing operation is carried out, in order to prevent inconsistencies which may remain for the primitives after calculation of the levels, by taking into account the chronological order according to the following rules:

| | | |
|---|---|---|
| (St, Nil) + (C−, *) | gives | (St, Nil) |
| (St, Nil) + (D+, *) | gives | (St, Nil) |
| (C+, *) + (St, Nil) | gives | (St, Nil) |
| (D−, *) + (St, Nil) | gives | (St, Nil) |
| (St, Nil) + (St, Nil) | gives | (St, Nil) |

This provides a representation of the second derivative of the pressure at the well bottom, coded in the form of a phrase, for example:

(St, +1), (D+, *), (St, +1/4), (D+, *), (St, Nil)

Another substep in the method of the invention, referred to as learning, consists in translating the various known theoretical models of wells, reservoirs and reservoir limits, in the formalism which uses the second derivative, in the form of words obtained by the segmentation and the coding of the flows.

The third step of the invention, known per se, is that of the structural analysis of the coding results obtained from the second step. It consists in searching, from among the known models of wells, reservoirs and reservoir limits, translated into coded phrases during the learning substep, the model or models closest to the phase representing the second derivative of the pressure at the well bottom in coded form.

I claim:

1. Method for automatic identification of the nature of a pressurized hydrocarbon production well, the nature of a reservoir associated with said well and the possible limits of said reservoir, on the basis of recording measurements of the pressure of the hydrocarbons at the well bottom as a function of time, consisting in performing the following steps:

preprocessing the measurements of the pressure at the well bottom in order to obtain a preprocessed signal, by calculating the first derivative of the pressure at the well bottom with respect to a function of time, representing the shape of the preprocessed signal in a coded form, performing structural analysis of said coded form, in order to identify with one or more known models, coded in the same form as the preprocessed signal, the well, the reservoir and the possible limits of the said reservoir, characterized in that the step of preprocessing the measurements of the pressure furthermore consists in performing the following substeps:

smoothing the result of the calculation of the first derivative of the pressure, estimating regular points of said smoothed first derivative, then replacing said smoothed first derivative by an equivalent signal sampled with a constant step, filtering said equivalent signal, calculating the second derivative of the pressure at the well bottom by differentiating a function of said filtered signal with respect to a function of time, filtering the result of the calculation of said second derivative, carrying out linear segmentation of said filtered second derivative, in order to obtain the preprocessed signal having a plurality of segments, and the step of representing the shape of the preprocessed signal in a coded form consists in performing the following substeps:

choosing a syntax including an alphabet consisting of a series of letters for describing the direction of the variations of the preprocessed signal, and attributes for describing the values of the said variations, associating, with each segment of the preprocessed signal, the letter of the alphabet describing the direction of variation of said preprocessed signal, calculating the slope of each segment of the preprocessed signal, which constitutes the value of the attribute, the sequence of letter/attribute pairs constituting a phrase representing the preprocessed signal, itself representing the second derivative of the pressure.

2. Method according to claim 1, characterized in that the second derivative of a function of the pressure of the hydrocarbons at the well bottom with respect to a function of time is calculated by applying the following formula: P"(t)=dLogP'(t)/dLog(t), in which:

P"(t) represents the second derivative of a function of said pressure with respect to a function of time, t represents time P'(t) represents the first derivative of said pressure with respect to a function of time, calculated by applying the following formula: P'(t)=dP(t)/dLog(t), in which P(t) represents the said pressure and t represents time.

* * * * *

UNITED STATES PATENT AND TRADEMARK OFFICE

CERTIFICATE OF CORRECTION

PATENT NO. : 5,959,203

DATED : September 28, 1999

INVENTOR(S) : Mohamed AJJOUL

It is certified that error appears in the above-identified patent and that said Letters Patent is hereby corrected as shown below:

On the title page, item [75], the inventor's name should be:

--Mohamed Ajjoul--

Signed and Sealed this

Twentieth Day of June, 2000

*Attest:*

Q. TODD DICKINSON

*Attesting Officer*

*Director of Patents and Trademarks*